US009320337B2

(12) United States Patent
Bouix et al.

(10) Patent No.: US 9,320,337 B2
(45) Date of Patent: Apr. 26, 2016

(54) HEATED COSMETIC SAMPLER WITH INCORPORATED APPLICATOR

(71) Applicant: ELC Management LLC, Melville, NY (US)

(72) Inventors: Herve F. Bouix, New York, NY (US); Christophe Jacob, Franqueville-Saint-Pierre (FR)

(73) Assignee: ELC MANAGEMENT, LLC, Melville, NY (US)

( * ) Notice: Subject to any disclaimer, the term of this patent is extended or adjusted under 35 U.S.C. 154(b) by 154 days.

(21) Appl. No.: 14/309,368

(22) Filed: Jun. 19, 2014

(65) Prior Publication Data

US 2015/0366322 A1 Dec. 24, 2015

(51) Int. Cl.

| | |
|---|---|
| ***A45D 40/18*** | (2006.01) |
| ***H05B 1/02*** | (2006.01) |
| ***A45D 40/00*** | (2006.01) |
| ***H05B 3/02*** | (2006.01) |
| ***H05B 3/14*** | (2006.01) |
| ***H05B 3/34*** | (2006.01) |
| ***A45D 40/26*** | (2006.01) |

(52) U.S. Cl.

CPC ..... *A45D 40/18* (2013.01); *A45D 40/0087* (2013.01); *A45D 40/265* (2013.01); *H05B 1/0252* (2013.01); *H05B 3/026* (2013.01); *H05B 3/145* (2013.01); *H05B 3/146* (2013.01); *H05B 3/34* (2013.01); *A45D 2200/155* (2013.01); *A45D 2200/157* (2013.01); *A45D 2200/25* (2013.01); *H05B 2203/002* (2013.01); *H05B 2203/005* (2013.01); *H05B 2203/013* (2013.01); *H05B 2203/016* (2013.01); *H05B 2203/02* (2013.01); *H05B 2203/021* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,982,838 | A * | 1/1991 | Fitjer | A45D 40/0087 132/317 |
| 5,775,344 | A * | 7/1998 | Clay | A45C 11/008 132/218 |
| 5,856,653 | A * | 1/1999 | Boudreaux | H05B 3/00 219/386 |
| 7,108,438 | B2 * | 9/2006 | Fontaine | A45D 40/265 219/424 |
| 7,398,898 | B2 * | 7/2008 | Bouix | A45D 34/045 222/183 |
| 9,173,471 | B2 * | 11/2015 | Inoue | A45D 34/046 |

* cited by examiner

*Primary Examiner* — David Walczak
(74) *Attorney, Agent, or Firm* — Peter Giancana

(57) ABSTRACT

A system for a heating packette with incorporated product applicator. One or more outer surfaces of the packette comprise printed heating elements, printed circuit elements and a means of connecting to a power source. The packette is designed to be used away from the home, and without connecting to a power grid.

14 Claims, 13 Drawing Sheets

HEATED COSMETIC SAMPLER WITH INCORPORATED APPLICATOR

FIELD OF THE INVENTION

The invention is in the field of cosmetic and personal care packettes, specifically those that incorporate a product applicator, and which may be freely distributed in magazines and other promotional programs. The invention is also directed to heated cosmetic products.

BACKGROUND

Packettes for distributing product are well known in the cosmetic and personal care fields. A basic packette that is suitable for distribution in magazines and elsewhere is made conventional paper webs that are coated to prevent oil absorption. Alternatively, plastic laminates and foil laminates are also used. A typical packette may comprise a sheet having first and second panels which are able to fold against each other, and bond along the perimeter of the panels. Bonding may be achieved by a continuous line of adhesive or welding, for example. Each panel of the packette may be on the order of 100μ to 250μ thick, and a reservoir for product is defined between the bonded panels.

Many packettes are basically rectangular or square, and measure 25 mm-150 mm on a side, while larger and smaller packettes, and differently shaped packettes are also known. The two opposing panels of the packette may be decorated by any suitable means known in the packaging arts, such as ink printing. Sometimes, the packette materials are treated to impart an improved quality to finished packette. For example, foil packettes may be treated to make the foil less permeable to air and water. Plastic packettes may be treated to prevent yellowing of the packette material. Many types of treatment are known for application to either the inside or the outside of the packette.

Also known are packettes that incorporate a product applicator. The applicator is for retrieving product form the packette and/or applying product to an application surface. With this type of packette, at least a portion of the first and second panels may be bonded to a rigid plastic insert, rather than to each other. A portion of the insert is shaped as a neck and/or collar that defines an orifice. The orifice leads into the reservoir between the first and second panels, and supports a product applicator. The product applicator is designed as a closure for the neck/collar, and together they make a sealing engagement, so that the product in the reservoir may be preserved. A means for accessing the product in the reservoir is also provided. This may be a wand-type applicator that is dipped into the product reservoir. Alternatively, the applicator supported by the neck/collar may be a flow through applicator. With this type of applicator, product is squeezed out of the reservoir, through the applicator and onto an exterior surface of the applicator.

In the cosmetics and personal care field, some packettes are used for distributing on the order of 1 g to 5 g of product, or enough product for exactly one application (i.e. a single-use packette). These single-use packettes are not usually provided with means to reseal the packette after it has been opened by a user. Single-use packettes are suitable to give away as free product samples, or they may be sold in bulk quantities. Packettes that are suitable for holding more than 1 g to 5 g of product are also used in the cosmetics and personal care markets. These packettes may be designed to supply enough product for two, three or more complete makeup or personal care treatments, rather than just one. In this case, the packettes may be resealable. These multi-use packettes may contain 10 g or more of product, and are intended for individual retail sale, or for sale in bulk quantities.

Packettes are suitable for holding a wide range of products, including creams, lotions, gels, liquids, powders and pastes; skin treatment products, color makeup products and fragrance products. Any of these product types may be suitable for use a with an applicator, which can be provided with either a single-use or multi-use packette, as just described.

Nowadays, personal care companies seek to attract consumers by incorporating a source of heat into the cosmetic or personal care experience. Up to now, the cost and complexity of doing so has prevented companies from supplying means to heat packettes that are intended to be given away as a free sample. However, when a free packette sample is intended to drive the sale of a commercial size heated product, then it would be advantageous if the product supplied by the packette were also heated. A system for heating packettes that is convenient and portable meets a real consumer need and provides a market advantage. The present invention addresses this need.

Objectives

A main objective of the present invention is to provide a simple means for heating the product inside a cosmetic or personal care packette with applicator.

Another objective is to economically provide a packette of heat activated cosmetic or personal care product, immediately prior to use of the product.

Another objective is to provide a packette with applicator that can be heated, and optionally, reheated, anywhere, without connecting to a power grid or electric mains.

Another objective of the present invention is to transform the use of a conventional packette into a multi-sensory experience.

SUMMARY

The present invention is a system for a heating packette with incorporated product applicator. One or more outer surfaces of the packette comprise printed heating elements, printed circuit elements and a means of connecting to a power source. The packette is designed to be used away from the home, and without connecting to a power grid.

DETAILED DESCRIPTION

Figure 1:
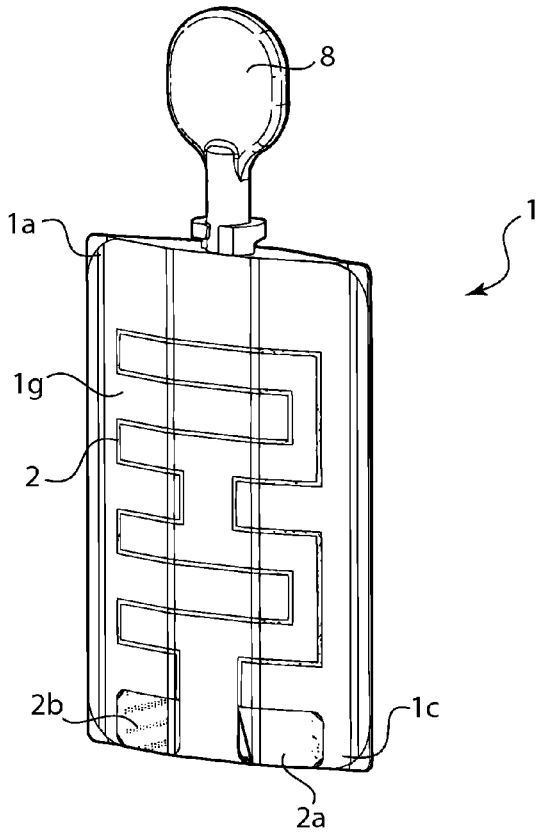
FIG. 1 is perspective view of one embodiment of a heating packette with incorporated applicator of the present invention.
Figure 2:
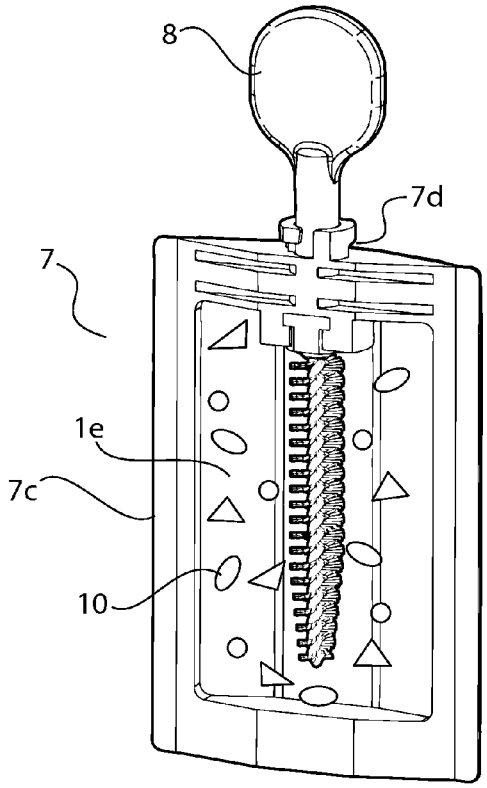
FIG. 2 is the same as FIG. 1, but with the front panel removed.

By "single-use" packette, we mean a packette without a means to reseal the packette after it has been opened by a user. Preferred single-use packettes hold 10 g or less of product; more preferably 5 g or less of product; most preferably 2 g or less of product.

By packette with "incorporated applicator" we mean that prior to first use, the applicator is specifically designed to seal the orifice of the packette.

By "comprise", we mean that a group of elements is not limited to those explicitly recited, but may or may not include additional elements.

The Heating Packette

We describe packettes that are basically rectangular or square, and measure about 25 mm-150 mm on a side. Larger and smaller packettes, and differently shaped packettes are also known, and the principles of the present invention may be applied, in a straight forward manner, to those as well.

First Embodiment

Referring to FIGS. 1-7, a packette (1) according to a first embodiment of the present invention comprises front and back panels (1*a*, 1*b*), rigid insert (7), and incorporated applicator (8). In this embodiment, the rigid insert is fashioned as a plastic rectangular frame, having front and back faces (7*c*, 7*c*'). The "top" of the packette is the side from which the incorporated applicator extends. The frame is sufficiently wide toward the top center to provide space for an integrally molded neck (7*a*). The neck is hollow and defines an orifice (7*b*) that leads into the reservoir (1*e*). The neck also forms a locking or retaining engagement with an incorporated applicator (8). Optionally, but preferably, the rigid insert supports a wiper (9) below the orifice (7*b*), for dressing product on the applicator head.

Each panel (1*a*, 1*b*) has a respective perimeter portion (1*c*, 1*c*'), that extends in slightly from the edges of the panel. The perimeter of each panel is bonded to the front and back faces (7*c*, 7*c*') of the rigid insert (7), thus forming a reservoir (1*e*) that may only be accessed through the neck (7*a*) of the rigid insert. A cosmetic product (10) is disposed in the reservoir, being filled through the neck. Bonding of the panels to the rigid insert may be achieved by a continuous line of adhesive or welding, such as sonic welding, for example. Preferably, this seal is airtight to protect the contents of the packette from dry-out and contamination.

The applicator (8) may be a separable, wand-type applicator. A wand-type applicator (8) comprises a handle (8*a*), a stem (8*b*) and applicator head (8*c*). When engaged to the neck (7*a*), the applicator head (8*c*) of a wand type applicator is disposed in the reservoir (1*e*). A wand-type applicator may or may not be able to reseal the reservoir. As examples of the former, the stem may be equipped with lugs (8*d*) that cooperate with a lug grooves (7*d*) of the rigid insert (7); or, the applicator and neck may support cooperating threads. As an example of the latter, the applicator and neck may be integrally molded, but designed to break apart along a fault line, thus opening the packette. The stem (8*b*) and the orifice (7*b*) may be sized for interference, so that contact between the stem and orifice forms a sealing surface, while still allowing the stem to slide within the orifice. Alternatively or additionally, contact between the stem and wiper may form a sealing surface that is sufficient to keep the product (10) in the reservoir fresh. The applicator head may be any type of cosmetic or personal care applicator head, such as a brush, comb, foam or flocked surface, product scoop, dropper, etc.

Figure 17:
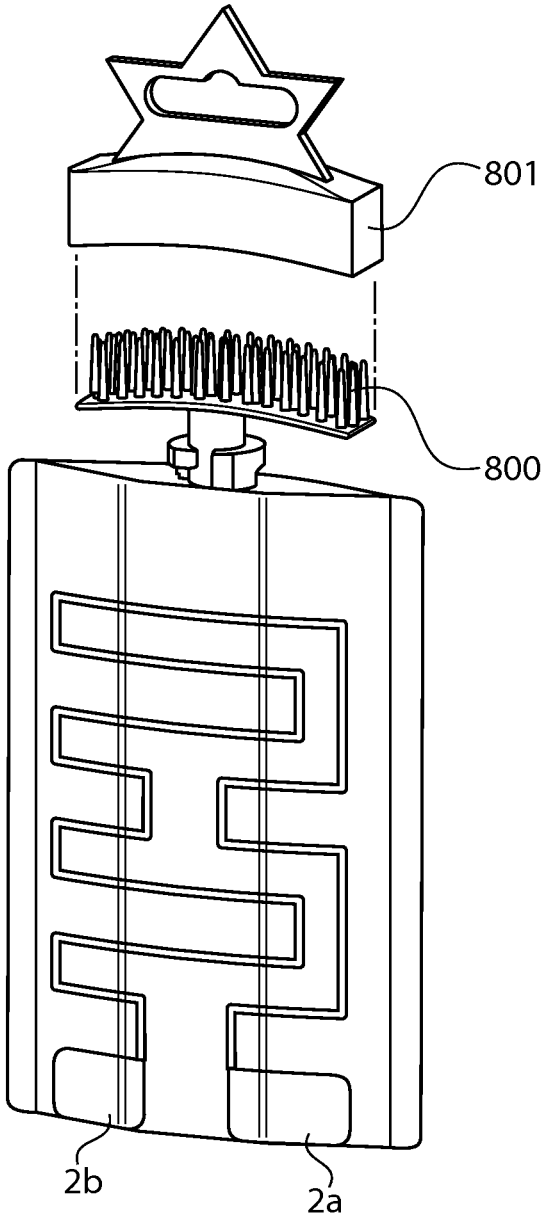
FIG. 17 depicts a heating packette having an incorporated flow-through applicator.

Alternatively, the applicator (800) may be a non-separable flow through-type applicator (see FIG. 17). This type of applicator remains connected to the neck of the rigid insert (7), and may be provided with a cap (801) to protect the applicator head, whether the packette is for single use or multiple use.

The panels (1*a*, 1*b*) of the packette (1) are flexible, and may comprise one material, or a stack, or laminate of different materials. Some useful examples of packette materials include films of polyethylene (PE; low, medium and high density); polyethylene terephthalate (PET); polypropylene (PP); ethylene vinyl acetate (EVA); polybutylene (PB); vinyls; polyesters; styrene polymers; nylon; polycarbonate; acrylics; acrylonitriles; fluoropolymers; cellophane; and aluminum foil. Laminates of these may also be used. For example, a packette comprising an external layer of PET and an internal layer of low density polyethylene (LDPE), is useful for the invention. Laminates that include aluminum foil to increase heat transfer through the packette are also useful. One example of this is PET12/Alu09/PET12/PE75. Most panel constructions are opaque, but one example of a transparent laminate that could be used for the panels is PET12/PET12 coated with silicon oxide/PE75. In this case, the product inside the packette would be visible from the exterior.

Heat transfer through the panels (1*a*, 1*b*) of the packette (1) is a function of the thickness of the panels. Therefore, the actual thickness of the panels should be chosen based on the rate of heat transfer and the desired length of time to heat the product (10). The thicknesses of the panels (1*a*, 1*b*) of the packette (1) may typically be on the order of about 100μ to 250μ; preferably 100μ to 200μ; more preferably 100μ to 150μ. Packette laminates are usually chosen for their enhanced barrier properties, such as low gas permeability and moisture protection. However, for use in the present invention, we should also consider a laminate's ability transfer heat as well as its ability to accept inks used in printed circuitry.

Also, heating of a product (10) in a packette (1) will be more even and efficient when there is a minimum of empty space. Therefore, it is preferable if the volume of the reservoir is not much larger than the volume of product that it contains. A reservoir may be generally rectangular (possibly square), and measure 25 mm-150 mm by 25 mm-150 mm.

At least one heating element is in physical contact with at least one of the panels (1*a*, 1*b*) of the packette (1). Preferably, both panels are in contact with at least one heating element. The heating elements (2, 2') are located on the exterior surfaces (1*g*, 1*h*) of the panels (1*a*, 1*b*). As heat is generated in the heating element(s), some of the heat makes its way to the product (10) in the reservoir (1*e*), thereby raising the temperature of the product.

In one embodiment, the heating elements (2, 2') are formed as continuous electric paths of lengths L and L', that have a positive terminal (2*a*, 2*a*') and a negative terminal (2*b*, 2*b*') located on or near the perimeter portion (1*c*, 1*c*') of that panel on which the heating element is located. The resistive electric path loops over the panel of the packette to generate heat evenly over the panel. An external power source may be connected to the resistive path of the packette through power leads, thus completing a heating circuit. Preferably, the connection can be established and removed at will. For example, the connection may be achieved with metal clamps (3*a*, 3*b* in FIG. 10), such as alligator clips or other spring-loaded clips. Electricity from a source external to the packette arrives at one terminal (2*a*), passes through the circuit (2) where electrical resistance generates heat, and leaves at the other terminal (2*b*). Preferably, the second set of positive and negative terminals (2*a*', 2*b*') are located opposite the first set of terminals (2*a*, 2*b*). This way, connecting the heating element on one side of the packette to the power source may automatically connect the heating elements on the other side of the packette to the power source. Otherwise, separate connections must be provided.

Second Embodiment

Figure 8:
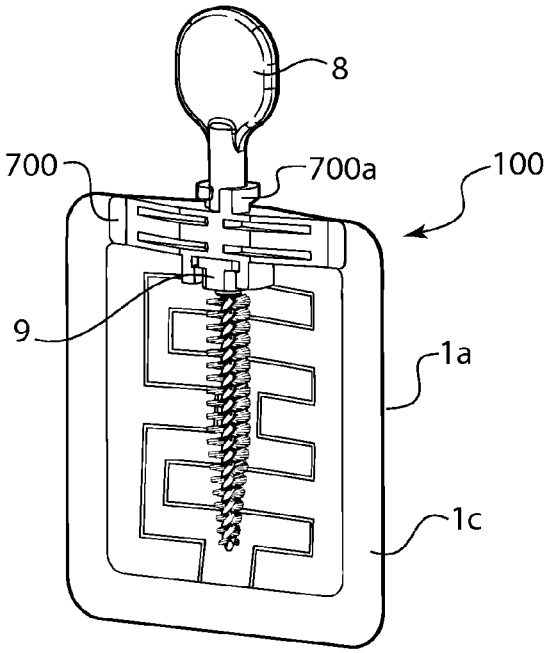
FIG. 8 is a perspective view of a second embodiment a heating packette with incorporated applicator, with the front panel removed.
Figure 9:
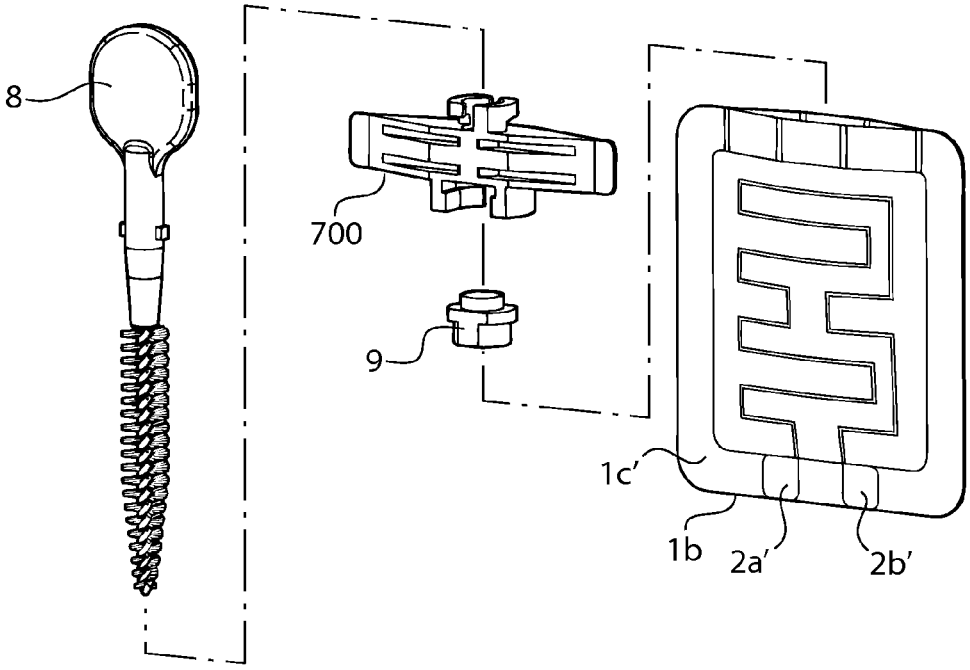
FIG. 9 is an exploded view of the packette of FIG. 8.

Referring to FIGS. 8-9, a packette (100) according to a second embodiment of the present invention is similar to the first embodiment, with a few exceptions. First, the rigid insert is fashioned as a neck insert (700), wider toward the center, and narrower elsewhere. The wider portion provides space for an integrally molded neck (700*a*), just like in the first embodiment. The rigid neck insert (700) interacts with the applicator (8) and the wiper (9) in the same manner as rigid insert (7) of the first embodiment. However, only a portion of the perimeters (1*c*, 1*c*') of each panel (1*a*, 1*b*) is bonded to the neck insert. The remainder of the perimeters of each panel are bonded to each other. Bonding of the panels to the rigid neck insert and to each other may be achieved by a continuous line of adhesive or welding, such as sonic welding, for example. Preferably, these seals are airtight to protect the contents of the packette from dry-out and contamination.

Because the front and back panels (1*a*, 1*b*) are bonded to each other over most of their perimeter, the panels may be fashioned as a single construction, then printed with conductive ink or have prefabricated flexible printed circuits applied, and then folded in half. This would allow positive terminals (2*a*, 2*a*') to be physically connected to each other, and the negative terminals (2*b*, 2*b*') to be physically connected to each other.

Connection to Power Source

Figure 10:
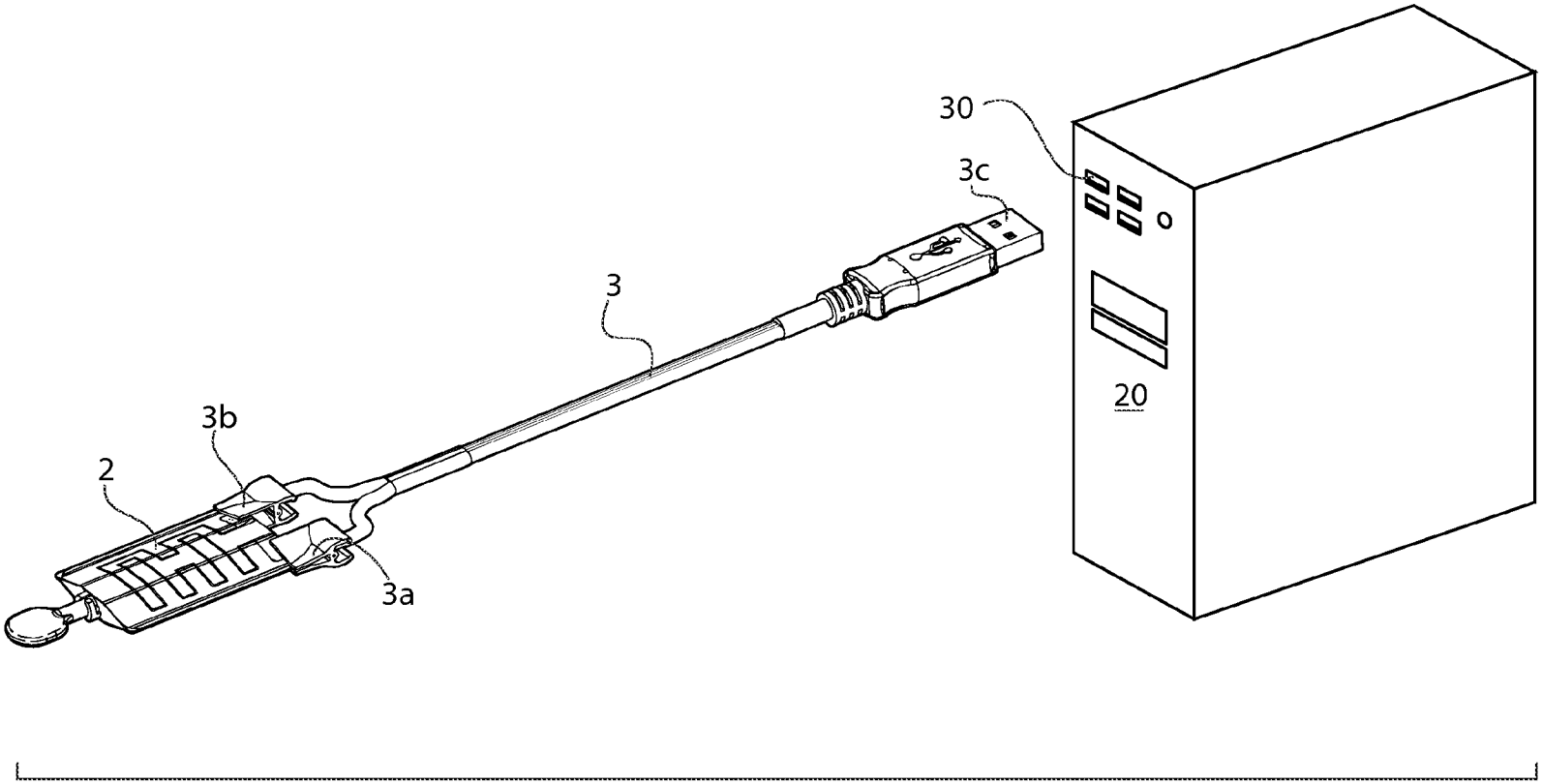
FIG. 10 is a perspective view of a first embodiment of a packette heating system wherein a USB type connector is attached to a packette to provide electrical power.
Figure 11:
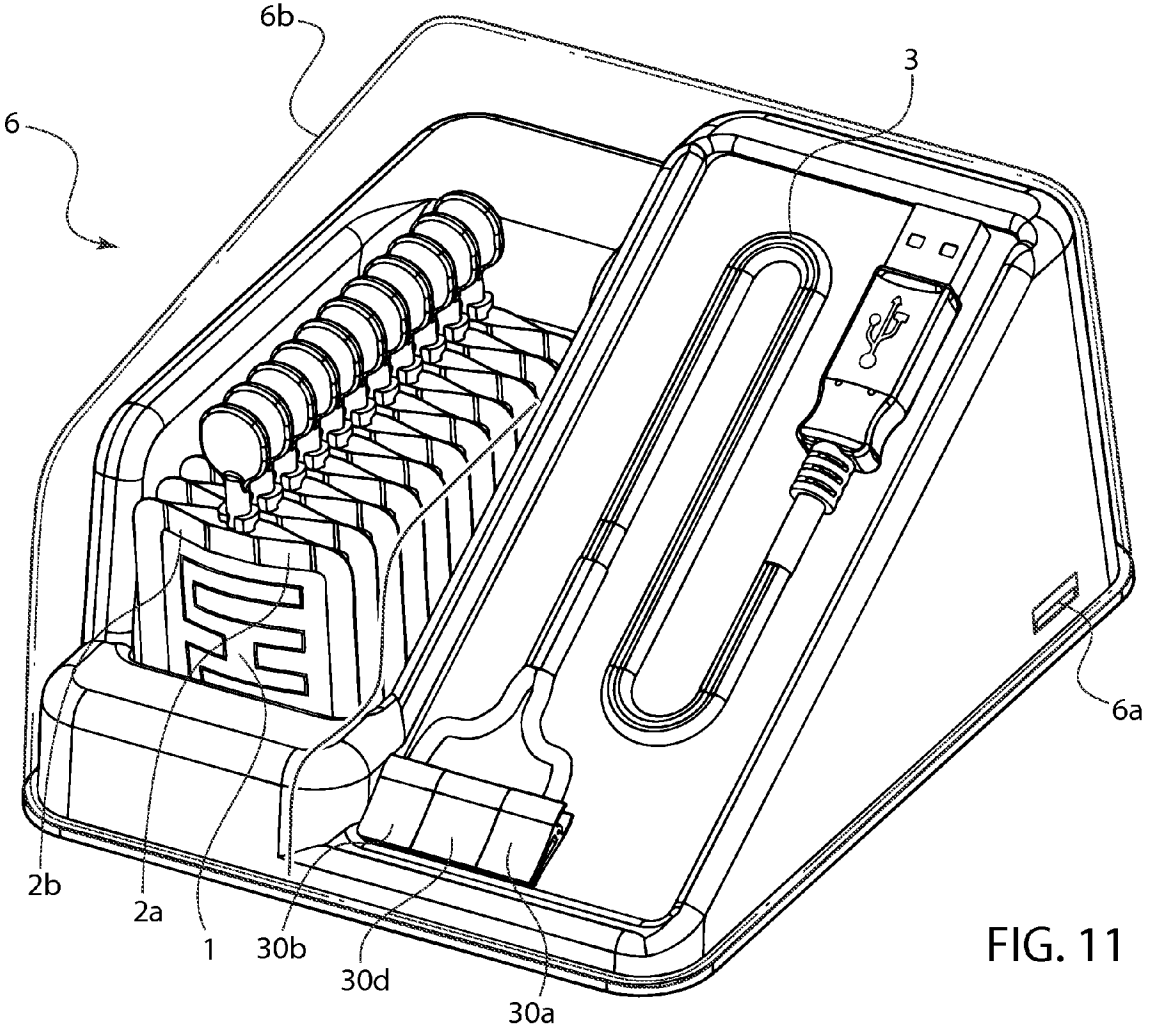
FIG. 11 depicts a kit that comprises multiple packettes, and a USB-type connector to be used in heating the packettes.

The heating packette with incorporated applicator (1) requires an electrical connection to a power source. The connection must be such that it can be established and removed at will (hereinafter, a "removable" connection to power). The present invention includes electric power leads that are designed to cooperate with the heating packette. One embodiment is shown in FIG. 10 where power cable (3) comprises metal clamps, such as spring loaded clips (3*a*, 3*b*), at one end, and a USB-type connector (3*c*) at the other end. With this embodiment, a heating packette according to the invention may be powered by connecting the USB-type connector to a charging device having a complementary USB jack (30), such as a computer (20), automobile console, courtesy outlet in a bus or plane, or other device that can provide low voltage electric power. Once contact is established between the spring loaded clips (3*a*, 3*b*) and the positive and negative terminals (2*a*, 2*b*) of the packette heating element, a heating circuit is completed (i.e. closed) and electricity will flow from the charging device, through the heating elements of the packette and back to the charging device. While this is happening, heat is generated, and the interior of the packette is heated. When the clips are removed, then the circuit is opened, and heating stops. In FIG. 11, the metal clips (30*a*, 30*b*) are shown as two parts of one clamp separated by an insulating portion (30*d*). The spacing of clips is designed to match the spacing of the positive and negative terminals (2*a*, 2*b*) of the packettes (1). Alternatively, in FIG. 10, the metal clips (3*a*, 3*b*) are not joined, and remain free of each other.

Figure 12:
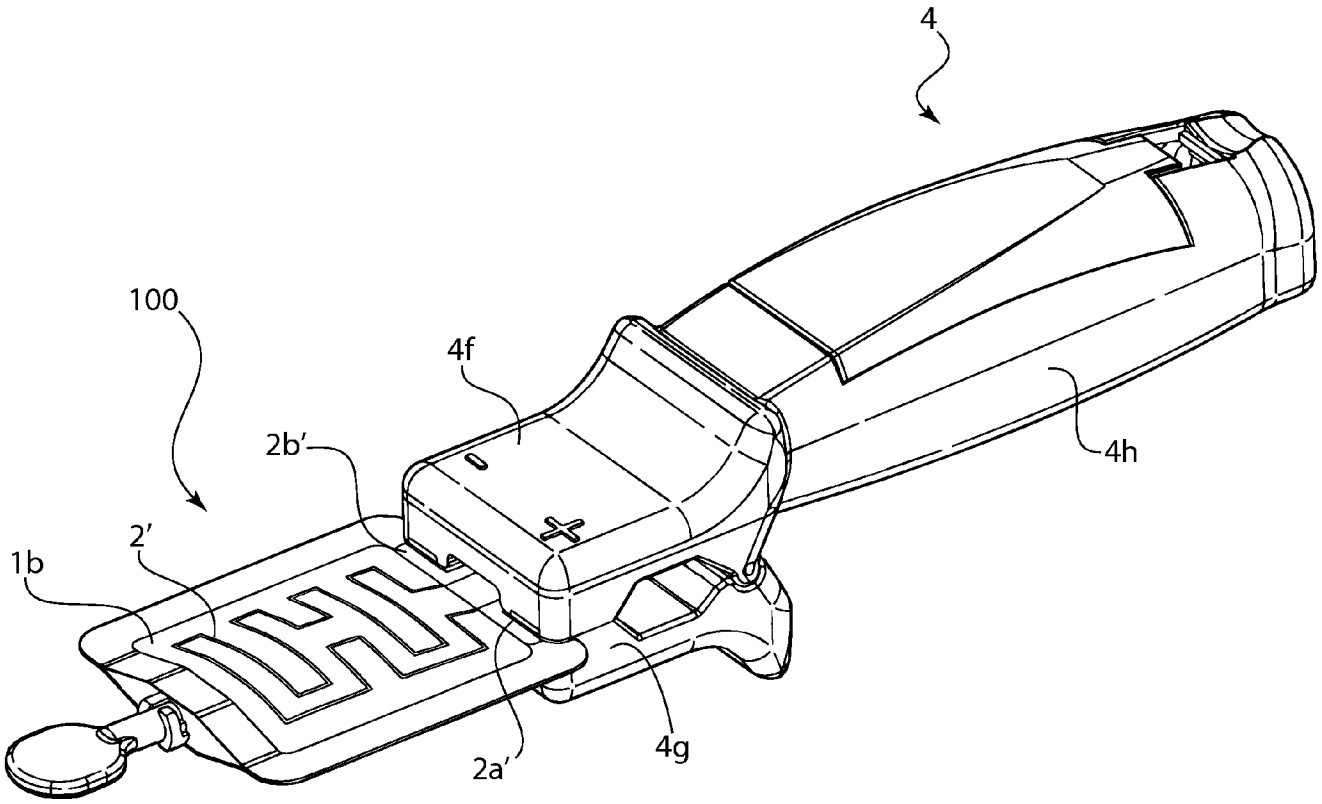
FIG. 12 is a perspective view a second embodiment of a packette heating system wherein power tongs are clipped onto a packette.
Figure 13:
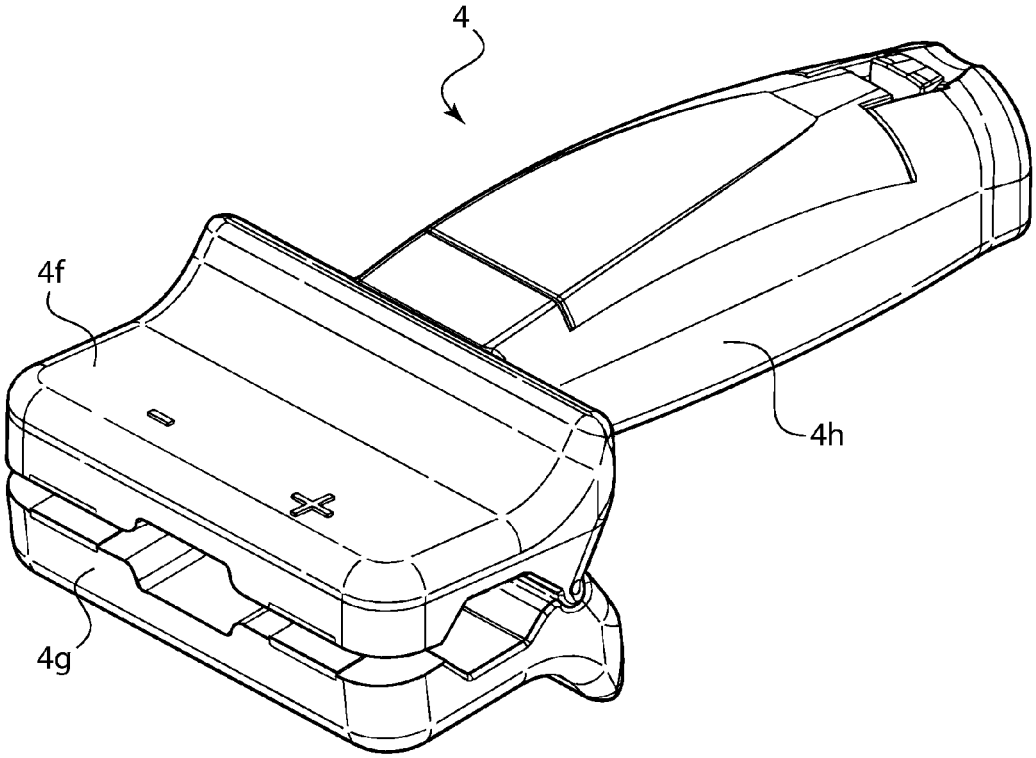
FIG. 13 shows one embodiment of a set of clip on power tongs for use with a heating packette of the present invention. The jaws of the tongs are shown in a opened position.
Figure 14:
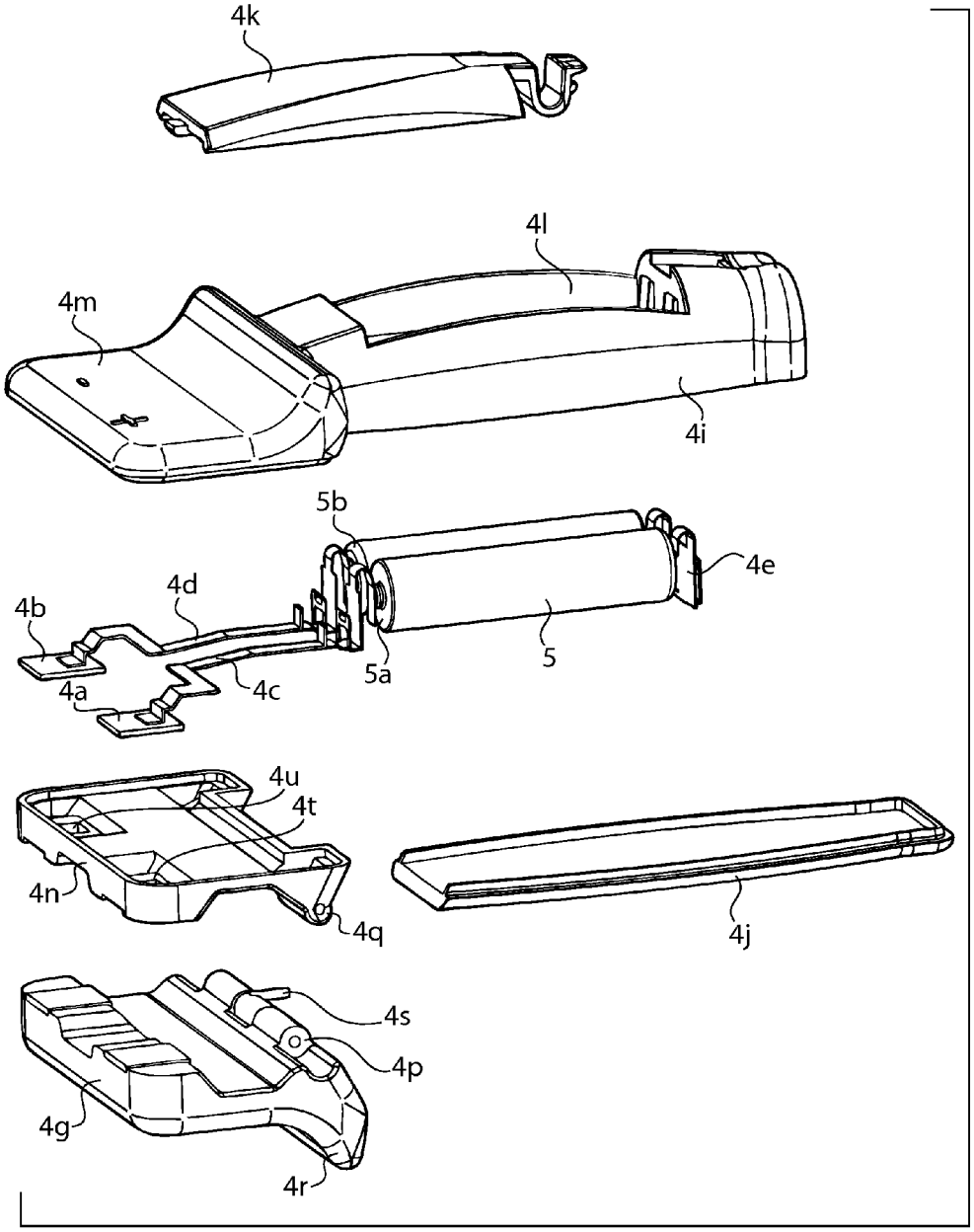
FIG. 14 is an exploded view of the power tongs of FIG. 13.
Figure 15:
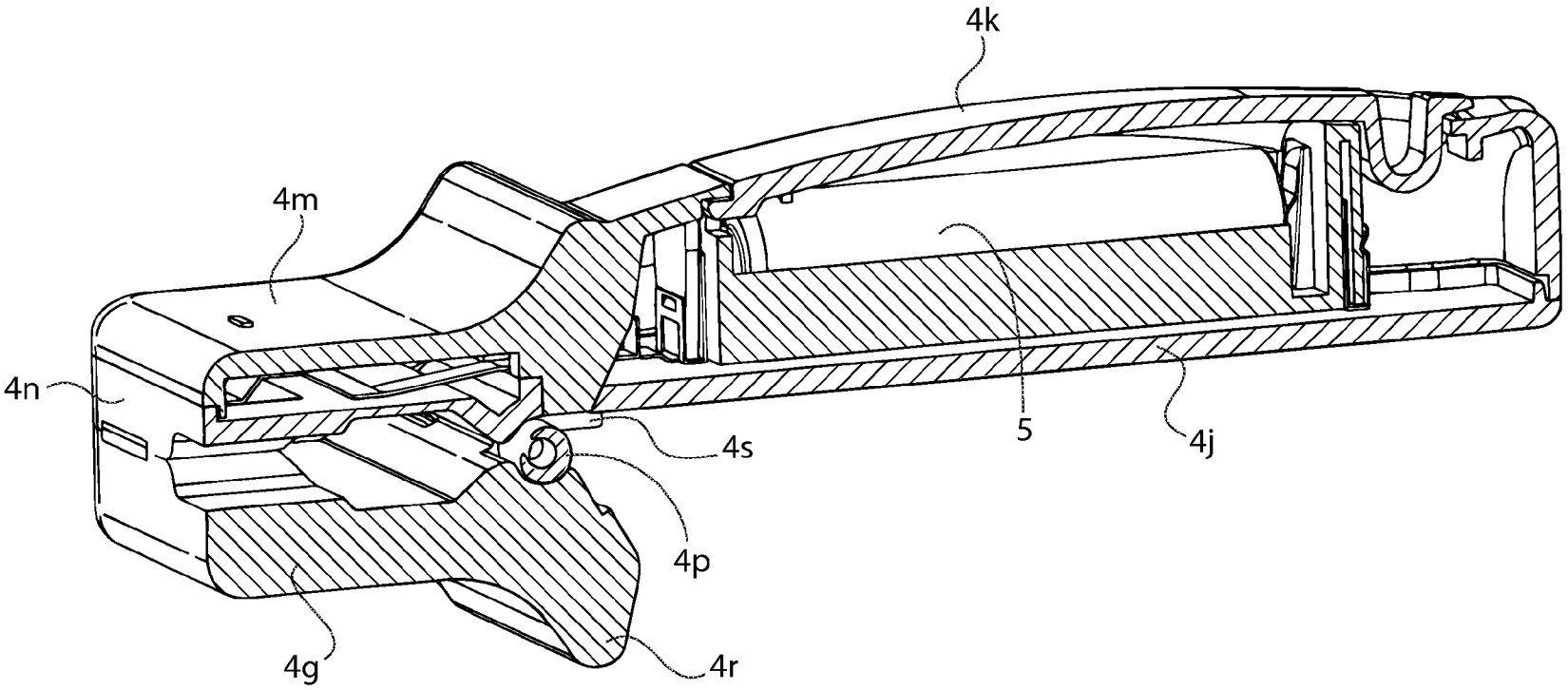
FIG. 15 is a cross sectional view of the power tongs of FIG. 13, except the jaws of the tongs are shown in an closed position.

FIGS. 12-13 show another embodiment of the electrical power leads that are designed to cooperate with the heating packette (a packette (100) according to the second embodiment is shown, but the first embodiment may also be used). Power tongs (4) are designed to clip onto the edge of the packette (100) and make electrical contact with the positive and negative terminals (2*a*, 2*a*', 2*b*, 2*b*') of the packette. The power tongs comprise a handle (4*h*), a stationary jaw (4*f*) and a spring loaded movable jaw (4*g*). The tongs are shown in more detail in FIGS. 14-15, and these will now be described.

The handle (4*h*) comprises a main body (4*i*), a base (4*j*), and a cover (4*k*). The main body, base and cover define a battery compartment (4*l*) that is suitable to house one, two or more batteries in electrical series. The cover is preferably removable by a consumer, so that the batteries (5) may be replaced. The stationary jaw (4*f*) comprises an upper stationary jaw (4*m*) and a lower stationary jaw (4*n*). The lower stationary jaw has two holes (4*t*, 4*u*) through which protrude the power terminals (4*a*, 4*b*). The power terminals are positioned such that they are able to simultaneously make contact with the positive and negative terminals (2*a*, 2*b*) of the heating element (2) of the packette (100). By "stationary jaw" we mean that the jaw is stationary with respect to the main body (4*i*) of the handle (4*h*).

The main body (4*i*), the base (4*j*). and the upper stationary jaw (4*m*) may be assembled after being individually manufactured, or they may be of unitary construction. The lower stationary jaw (4*n*) is connected to the upper stationary jaw after the power leads (4*c*, 4*d*) have been assembled, as shown. All parts may be assembled by any suitable means, such snap fitments, adhesive or welding. Once assembled, the upper and lower stationary jaws form one composite jaw element, in which pass the power leads (4*c*, 4*d*) that are able to ferry electricity to and from the one or more batteries (5), and to and from the power terminals (4*a*, 4*b*). The one or more batteries are provided in the battery compartment (4*l*). When there is more than one battery, these are electrically connected in series via one or more jumpers (4*e*). The cathode (5*a*) and the anode (5*b*) of the battery (or of the batteries in series) have electrical contact with power leads (4*c*, 4*d*).

The movable jaw (4*g*) comprises a hinge (4*p*) that cooperates with hinge (4*q*) of the lower stationary jaw (4*n*). In the embodiment shown, a pin-type hinge is provided to connect the two parts in a movable articulation. A spring element (4*s*) is provided that biases the movable jaw against the lower stationary jaw, so that the edge of the heating packette (100) may be held firmly between the jaws. When this is done, then the power terminals (4*a*, 4*b*), which protrude through the holes (4*t*, 4*u*) of the a lower stationary jaw (4*n*), have physical contact with the positive and negative terminals (2*a*, 2*b*) of the pouch heating element (2).

Once contact is established between the power terminals (4*a*, 4*b*) and the positive and negative terminals (2*a*, 2*b*) of the packette heating element (2), a heating circuit is completed (i.e. closed) and electricity will flow from the batteries through the heating elements of the packette and back to the batteries. If the positive and negative terminals (2*a*, 2*b*) have electrical contact with the positive and negative terminals (2*a*', 2*b*') on the opposite side of the packette (100), then electricity will also flow in a second heating element (2') located on the other side of the packette. While this is happening, heat is generated, and the interior of the packette is heated. When the jaws of the tongs are opened, and contact between the power terminals and heating element terminals is broken, the circuit is opened, and heating stops. The jaws of the tongs may be opened by applying finger pressure to the extension (4*r*) in the direction of the handle (4).

The power tongs are a relatively small, and of lightweight plastic and metal construction. The tongs are a handheld and portable device that is easy to use, thus making it possible to use a heating packette anywhere, even when mains power and a USB power connection are not available.

The Heating Element(s)

A heating element (2 or 2') of the present invention comprise one or more Flexible Printed Circuits. These may be formed as continuous resistive heating paths that have a positive terminal (2*a*, 2*a*') and a negative terminal (2*b*, 2*b*') located on or near the perimeter portion (1*c*, 1*c*') of that panel on which the heating element is located. The resistive electric path loops over the panel of the packette to generate heat evenly over the panel. Flexible Printed Circuits (FPCs) are well known by persons skilled in the art. A basic FPC comprises a dielectric substrate as a base, an adhesive layer on top of the substrate, conductor elements arranged on the adhesive, and a protective layer over the circuit elements. Typical substrate materials include polyimide, polyester, polyethylene, fluorocarbon films, aromatic polyamide papers, composites and many others. The substrate may be curved and/or flexible.

Typical conductor materials include metal foils, such as copper and aluminum, and metal mixtures including stainless steel, beryllium-copper, phosphor-bronze, copper-nickel and nickel-chromium resistance alloys. However, one of the most cost effective methods of depositing conductor material onto a flexible substrate uses conventional ink printing techniques. Polymer thick film (PTF) inks may be applied to a substrate using various technologies known from conventional ink printing, such as screen printing, flexography, gravure, offset lithography, and inkjet printing. Printed PTF electronics is a comparatively low cost, high volume process. PTF inks are a mixture of a polymer binder (i.e. polyester, epoxy, acrylic) and a granulated conductive material such as silver, resistive carbon or both. The ink may be applied directly to the substrate without a separate adhesive. Although silver and carbon polymer thick-film (PTF) inks are the most common inorganic inks, various companies offer an assortment of other ink types, such silver chloride, silver carbon, platinum, gold, and phosphors. Organic ink types include conductive polymers such as poly(aniline) and poly(3,4-ethylene dioxitiophene), doped with poly(styrene sulfonate). Polymer semiconductors include poly(thiopene)s like poly(3-hexylthiophene) and poly(9,9-dioctylfluorene co-bithiophen). Those inks that when cured offer greater flexibility and scuff resistance are generally preferred.

Of particular note for the present invention are positive thermal coefficient (PTC) inks, such as PTC-614, PTC-842, PTC-921 and PTC-922 inks available from Conductive Compounds (Hudson, N.H.). These inks are suitable for low DC voltage applications, and are self-regulating, which means that once a certain temperature is reached, the ink is able to maintain a temperature range (for example, 45° C. to 50° C. or 50° C. to 60° C. or 60° C. to 70° C.) without a feedback loop.

One or more FPCs may be incorporated into the invention by adhering one or more prefabricated FPCs to one or more surfaces of the heating packette (1) using an adhesive. Examples of prefabricated FPCs include those manufactured by Minco (Minneapolis, Minn.) and those manufactured by Tempco (Wood Dale, Ill.). Alternatively, one or more FPCs may be printed directly onto one or more exterior surfaces of the packette. In either case, the FPC may be applied to the packette either before or after the front and back panels (1*a*, 1*b*) of the packette are bonded to the rigid insert (7 or 700). Preferably, however, the FPC is applied to the panel or panels prior to bonding them to the rigid insert.

In general, the substrate of a Flexible Printed Circuit may incorporate bulkier non-printed electronic elements. Technically speaking, there is nothing that prevents the incorporation of such elements in the printed circuit of the packette (1 or 100); it's a question of cost and convenience. Electronic elements that may be useful include thermistors, timers, voltage regulators, capacitors, resistors, LEDs, integrated circuit chips, logic gates, etc.

In preferred embodiments of the tongs (4), power is supplied by one or more batteries. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. As noted, the handle (4*h*) comprises a cover (4*k*) that provides access to the battery compartment (4*l*), so that the batteries are replaceable. Optionally, the batteries are rechargeable. To that end, either the batteries can be removed from the handle, as just described, or the exterior of the system can be provided with electric leads to the batteries, such that the system can be reposed in a charging base, so that power from the base is transmitted to and stored in the batteries.

Figure 3:
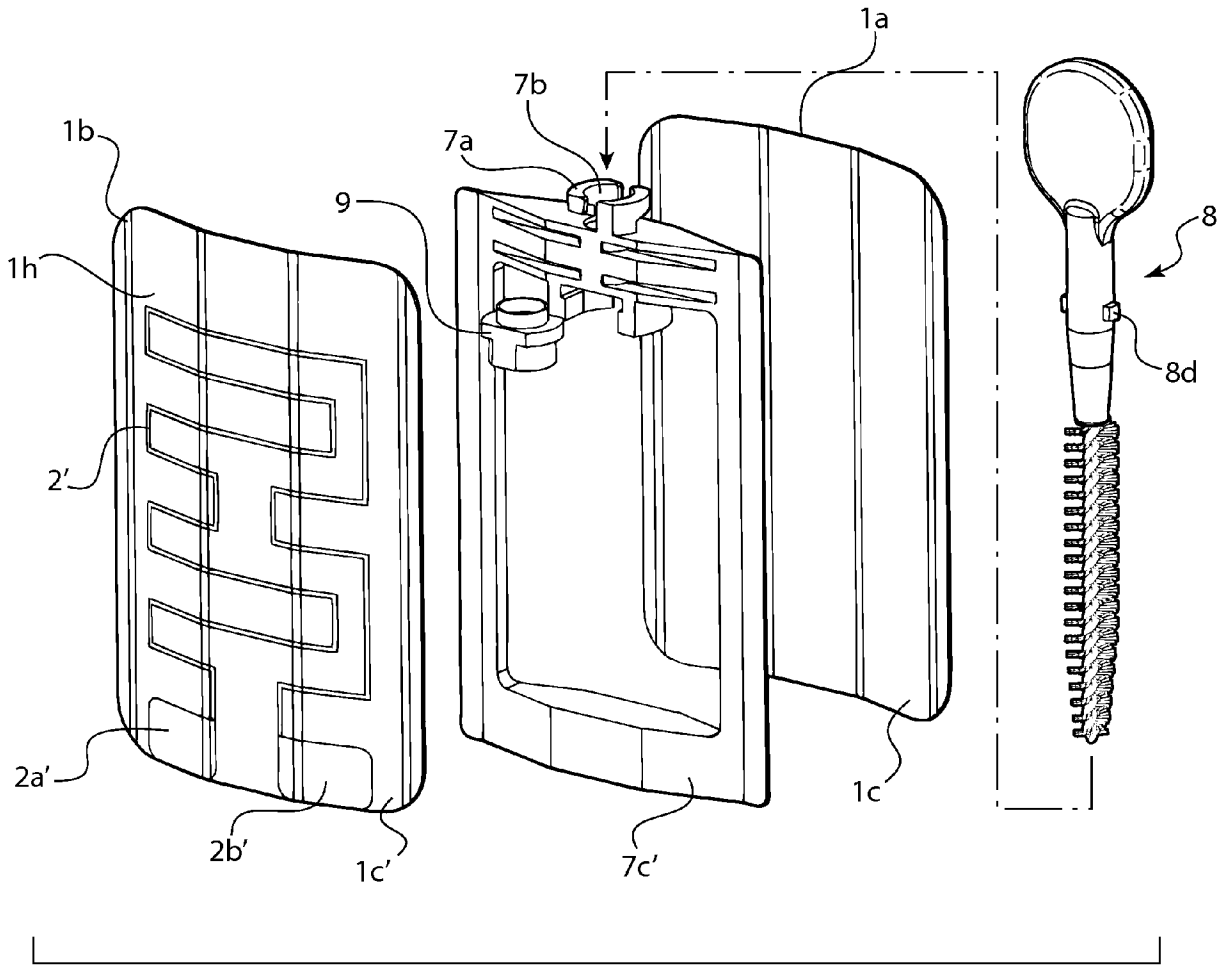
FIG. 3 is an exploded view of the packette of FIG. 1.
Figure 4:
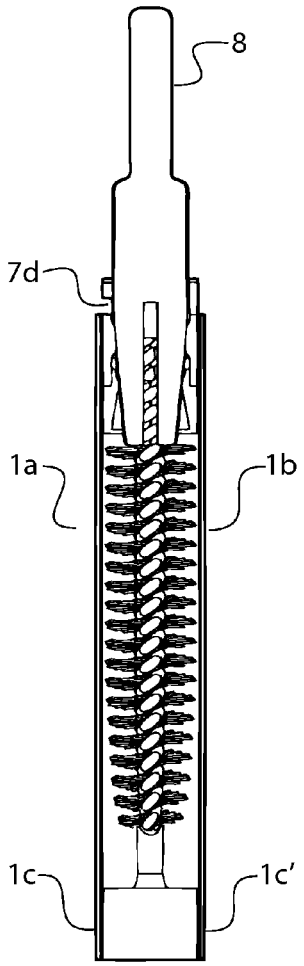
FIG. 4 is a side cross section view of the packette of FIG. 1.
Figure 5:
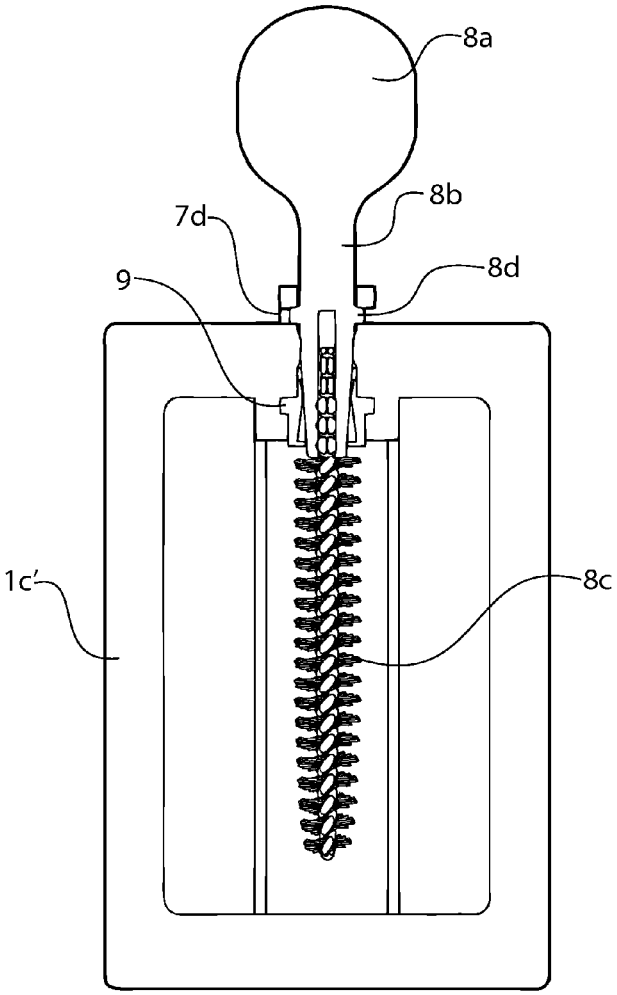
FIG. 5 is a back cross section view of the packette of FIG. 1.
Figure 6:
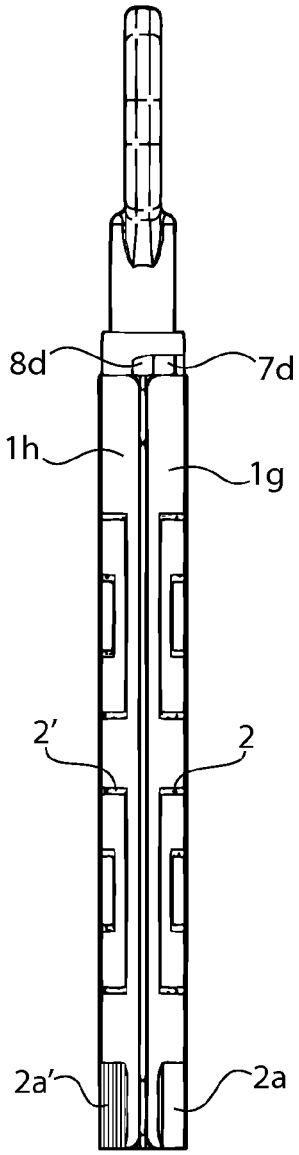
FIG. 6 is a side elevation view of the packette of FIG. 1.
Figure 7:
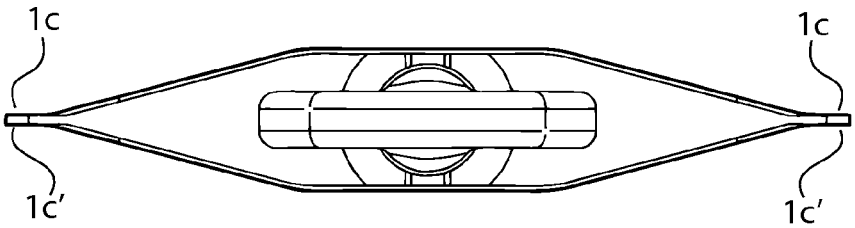
FIG. 7 is a top plan view of the packette of FIG. 1.

For increased heating efficiency, each printed heating element (2, 2') should cover an appreciable portion of the surface of the packette panels (1*a*, 1*b*). For example, as shown in FIGS. 1 and 3, the heating elements extend from one end of the packette (1) to the other, and from one side of the packette to the other. For guidance, it may be preferable if the ratio of the length, L or L', of the continuous resistive heating path (2 or 2') to the surface area of the panel (1*a* or 1*b*) on which the path is located, is 0.5:1 to 2:1 cm/cm$^2$.

In preferred embodiments, the time to heat a product (10) to at least 50° C. is 3 minutes or less; more preferred is 2 minutes or less. Experience has shown that when energy is converted at a rate of 5 W to 10 W, then the temperature of a packette according to the present invention may be raised by at least 25° C. in the requisite time. Some USB specifications fix the voltage at 5 V±5% (4.75 V to 5.25 V). A common battery has a nominal voltage of 1.5 V or 3.0 V. If up to four of them are used, then a voltage of about 12 V is available. A packette of the present invention utilizes low voltage typically in the range of 1.5 V to 12 V. By adjusting the resistance of the heating element, the desired power conversion rate may be achieved. The electrical resistance of the heating element can be adjusted by the composition of the ink, by the amount of ink deposited, and by the cross sectional area of the deposited ink. A useful range of heating element resistance is about 1Ω to about 15Ω; preferred is 2Ω to 10Ω; more preferred is 3Ω to 5Ω. For example, if the heating element resistance is between about 2.5Ω and 5Ω, then a 5 V power supply produces a current of about 1 A to 2 A, and power is provided at about 5 W to 10 W. In one working embodiment of the packette, these parameters resulted in the packette being heated to 50° C. in 2-3 minutes. The self-regulating nature of the positive thermal coefficient ink used in this circuit prevented the temperature from increasing beyond about 50° C., even if the circuit is left on for an extended period of time.

Methods of Use

In use, a person having a packette (1 or 100) according to the present invention, that contains a product (10), places the packette into the grip of a power tongs (4), such that electrical contact is established between the positive and negative terminals (2*a*, 2*b*) of the heating element (2), and the power terminals (4*a*, 4*b*) of the tongs. The packette and tongs are allowed to remain connected for a time sufficient to heat the product inside the packette to a desired application temperature. Thereafter, the packette is removed from the grip of the tongs, and heated product is removed from the packette.

Alternatively, a person having a packette according to the present invention, applies the two metal clips (3*a*, 3*b*) of the USB power cable (3) to the positive and negative terminals (2*a*, 2*b* an possibly 2*a*', 2*b*') of the heating element (2 and possibly 2'), as shown in the FIG. 10. The USB-type connector (3*c*) of the USB cable is inserted into a USB jack (30) on a computer (20), automobile console, courtesy outlet on a bus or plane, or other device that can provide electric power, such that electricity flows through the heating element. Electricity is allowed to flow through the heating element for a time sufficient to heat the product in the packette to a desired application temperature. Thereafter, the flow of electricity is stopped by removing the clips of the USB cable from the packette and/or removing the USB-type connector from the USB jack. Thereafter, the packette is removed from the grip of the metal clips, and heated product is removed from the packette.

At this point, if the applicator (8) is separable from the packette, then the applicator is unseated from the neck (7*a* or 700*a*) and the applicator head (8*c*) is lifted out of the reservoir, passing through the wiper (9). If the applicator is resealable on the neck, then the applicator head may be reinserted into the reservoir, and the retaining engagement may be re-engaged. This design is appropriate for multi-use packettes. Alternatively, the packette may not be resealable. For example, the applicator and neck may be integrally molded, but designed to break apart along a fault line, thus opening the packette. This design is appropriate for single use packettes, because once the fault line is broken, the packette cannot be resealed.

Alternatively, if the applicator (800) is a flow-through applicator, then cap (801) is removed, and the packette (1 or 100) is squeezed until a dose of heated product appears on an exterior surface of the applicator head. If additional product remains in the packette for future use, then the cap may be repositioned on the applicator head.

Some Optional Features

In some preferred embodiments, a shut off timer is included to preserve the batteries, in case a user accidentally leaves the circuit closed beyond the time needed to heat the product in the packette. Optionally, an indicator that tells the user when the application temperature is reached is included in the heating circuit. The indication may be incorporated into the packette or into the power tongs (4). The indicator may be a light (such as an LED) that turns on or off when the product reaches a desired temperature or after a predetermined time. Another indicator may be a thermo-chromic material incorporated into the packette, that turns a certain color when a set temperature has been reached.

In some embodiments, the USB cable (3) as described herein is preferred. By connecting the USB cable to a device with internet or other network access, it may be possible to transfer data to and from the packette, as well as power. For example, the packette may be configured with an integrated circuit having programmed instructions. When the heating circuit is completed by plugging the USB plug into an internet enabled device, the coded instructions of the packette may pass to the device, to initiate all sorts of informational and media experiences normally associated with such devices. For example, when the USB plug is inserted into an internet enabled device, a web site may be launched having content that complements the use of the product. For example, a video of a beauty advisor who offers advice and information about the use of one or more products may appear, or a promotional offer for a related product or service may be made. The experience may be interactive, so that the user is enabled to identify which product she is sampling, and the appropriate content can be downloaded to the user's device. The device must be able to provide sufficient power to heat the product, and still run the device. As consumer electronics continue to improve, the number of electronic devices that are able supply the requisite power will only increase. In the process, the use of a conventional product in a packette has been transformed into a multi-sensory experience.

The power tongs (4) will be preferred anytime that USB power is not conveniently available. For example, when travelling or at an in-store cosmetics counter, the power tongs may be preferred. A counter salesperson can heat sample after sample for curious consumers without the need to plug the heating packette (1) into a computer. Likewise, access to USB power may not be convenient when travelling, but the battery powered tongs (4) are handheld and convenient.

FIG. 11 depicts a kit that embodies one method of marketing a heating system for a cosmetic product according to the present invention. The kit comprises multiple packettes (1) containing a cosmetic or personal care product. The packettes are stacked or otherwise reposed in a base (6), along with a USB-type cable (3) to be used in heating the packettes. The base, stack of packettes and USB cable may be sold as a kit. Saleable kits that comprise at least seven packettes, or enough packettes for at least a one week supply of product, are preferred. Optionally, the base may house a power source, such as one or more batteries. In this case, the base also comprises a USB jack (6*a*) that is able to draw power from the power source. Optionally, the kit of FIG. 11 may be fitted over with a cover (6*b*). Preferably, the cover is at least partially transparent. In this embodiment, the kit is completely self contained.

Figure 16:
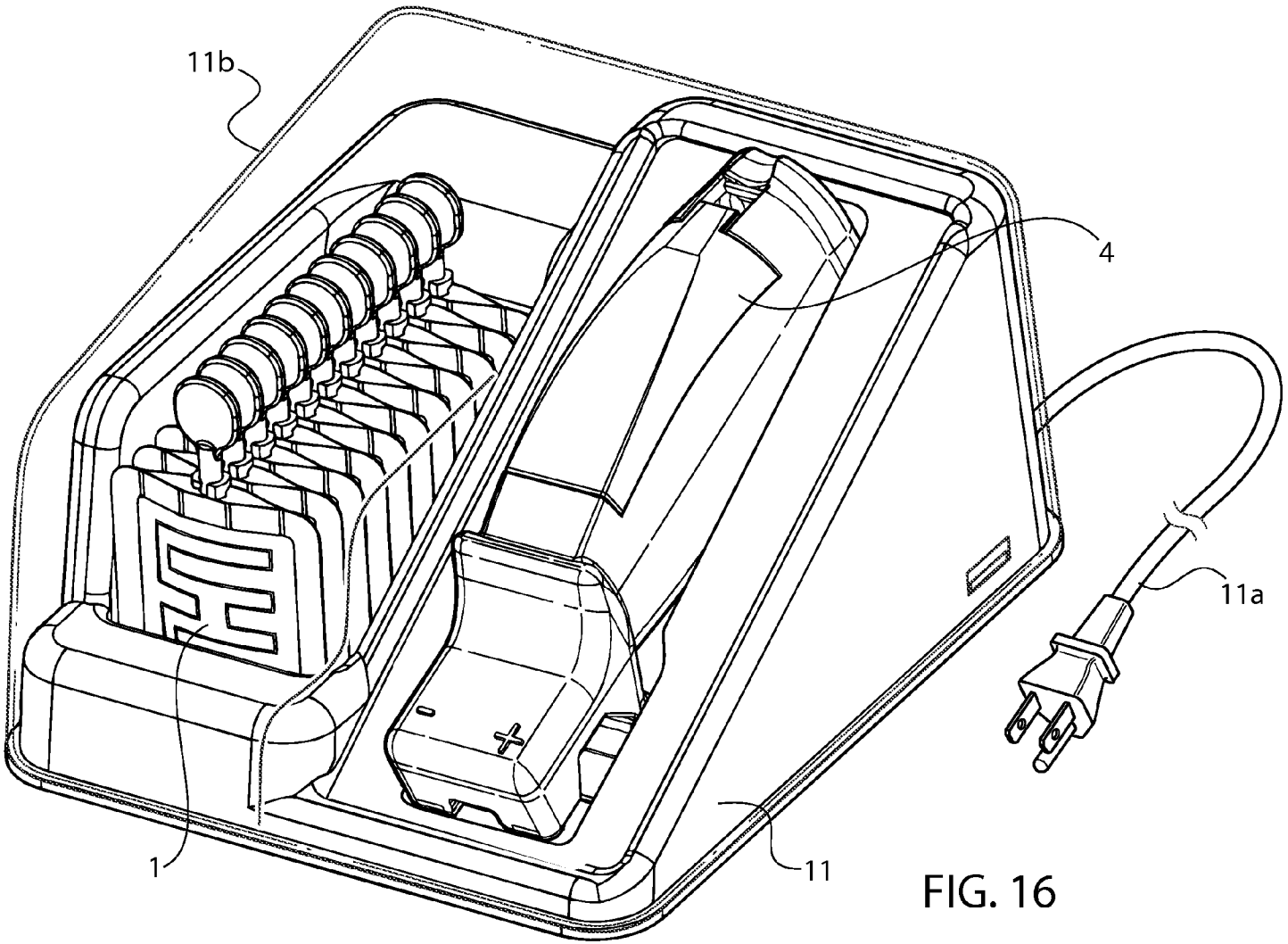
FIG. 16 depicts a kit that comprises multiple packettes and a power tongs to be used in heating the packettes.

FIG. 16 depicts a kit that embodies another method of marketing a heating system for a personal care or cosmetic product according to the present invention. The kit comprises multiple packettes (1 or 100) containing the product. The packettes are stacked or otherwise reposed in a base (11), along with a power tongs (4) to be used in heating the packettes. Optionally, the kit of FIG. 16 may be fitted over with a cover (11*b*). Preferably, the cover is at least partially transparent. The base, stack of packettes and power tongs may be sold as a kit. Saleable kits that comprise at least seven packettes, or enough packettes for at least a one week supply of product, are preferred. Optionally, the base may serve as a recharging station for the power tongs. In this case, the base also comprises a power cord (11*a*) that is able to draw power from a power mains, and electric leads that are able to convey power to the power tongs when the power tongs is reposed in the charging base.

What is claimed is:

1. A packette heating system comprising:

a packet that comprises:

a rigid insert having a hollow neck with an orifice;

front and back panels having:

perimeter portions that are bonded to the rigid insert;

a reservoir between the two panels that may be accessed through the hollow neck;

an applicator in retaining engagement with the neck;

at least one heating element that is in physical contact with at least one of the panels, wherein the heating element is a continuous resistive heating path of length, L, that has a positive terminal and a negative terminal located near the perimeter portion of that panel on which the heating element is located, and wherein the heating elements comprise a positive thermal coefficient ink that is printed onto the exterior surface of the front or back panel; and a power cable having two metal clips at one end, and a USB-type connector at the other end for connecting an external power source to the positive and negative terminals of the heating packette.

2. The packette heating system of claim 1 wherein the front and back panels are 100μ-250μ thick.

3. The packette heating system of claim 1 wherein the heating element has a resistance between 1Ω and 15Ω.

4. The packette heating system of claim 3 wherein the heating element is able to convert electrical energy into heat at a rate of 5 watts to 10 watts.

5. The packette heating system of claim 1 wherein the ratio of the length of the continuous resistive heating path to the surface area of the panel on which the path is located is 0.5:1 to 2:1 $cm/cm^2$.

6. The packette heating system of claim 1, further comprising a wiper, and wherein the applicator is a mascara applicator.

7. The packette heating system of claim 1 wherein the applicator is resealable on the neck.

8. The packette heating system according to claim 1 and further comprising a power source wherein the voltage of the power source is in the range of 1.5 V to 12 V.

9. The packette heating system of claim 1 wherein the packette is configured with an integrated circuit having programmed instructions, and wherein the power cable with USB-type connector is able to transfer data to and from the packette.

10. A packette heating system comprising:

a heating packette that comprises:

a rigid insert having a hollow neck with an orifice;

front and back panels having:

perimeter portions that are bonded to the rigid insert;

a reservoir between the two panels that may be accessed through the hollow neck;

an applicator in retaining engagement with the neck; and at least one heating element that is in physical contact with at least one of the panels, wherein the heating element is a continuous resistive heating path of length, L, that has a positive terminal and a negative terminal located near the perimeter portion of that panel on which the heating element is located, and wherein the heating elements comprise a positive thermal coefficient ink that is printed onto the exterior surface of the front or back panel; and a tongs that comprises:

a handle that houses one or more batteries;

a stationary jaw;

a movable jaw hinged to the stationary jaw and biased against it so that the packette may be gripped between the stationary jaw and the moveable jaw;

positive and negative power terminals positioned for simultaneous contact with the positive and negative terminals of the heating element when the packette is gripped between the stationary jaw and the moveable jaw; and positive and negative power leads that are able to ferry electricity between the one or more batteries and the positive and negative power terminals.

11. A kit comprising:

a base;

multiple heating packettes containing a cosmetic product reposed in the base, wherein each heating packette comprises:

a rigid insert having a hollow neck with an orifice;

front and back panels having:

perimeter portions that are bonded to the rigid insert;

a reservoir between the two panels that may be accessed through the hollow neck;

an applicator in retaining engagement with the neck; and at least one heating element that is in physical contact with at least one of the panels, wherein the heating element is a continuous resistive heating path of length, L, that has a positive terminal and a negative terminal located near the perimeter portion of that panel on which the heating element is located; and a power cable having two metal clips at one end, and a USB-type connector at the other end.

12. The kit of claim 11 wherein the base comprises a USB jack that is able to draw power from a power source housed within the base.

13. A kit comprising:

a base;

multiple heating packettes containing a cosmetic product reposed in the base, wherein each heating packette comprises:

a rigid insert having a hollow neck with an orifice;

front and back panels having:

perimeter portions that are bonded to the rigid insert;

a reservoir between the two panels that may be accessed through the hollow neck;

an applicator in retaining engagement with the neck; and at least one heating element that is in physical contact with at least one of the panels, wherein the heating element is a continuous resistive heating path of length, L, that has a positive terminal and a negative terminal located near the perimeter portion of that panel on which the heating element is located; and a power tongs that comprises:

a handle that houses one or more batteries;

a stationary jaw;

a movable jaw hinged to the stationary jaw and biased against it so that a packette may be gripped between the stationary jaw and the moveable jaw;

positive and negative power terminals positioned for simultaneous contact with the positive and negative terminals of the heating element when the packette is gripped between the stationary jaw and the moveable jaw; and positive and negative power leads that are able to ferry electricity between the one or more batteries and the positive and negative power terminals.

14. The kit of claim 13 wherein the batteries are rechargeable, and the base comprises a power cord that is able to draw power from a power mains, and electric leads that are able to convey power to the power tongs when the power tongs is reposed in the base so that the power is transmitted to and stored in the batteries.

* * * * *